United States Patent [19]

Allsop

[11] 4,113,159

[45] Sep. 12, 1978

[54] SHOE RETAINING AND CARRYING DEVICE

[76] Inventor: Ivor J. Allsop, 2079 N. Shore Rd., Bellingham, Wash. 98225

[21] Appl. No.: 848,098

[22] Filed: Nov. 3, 1977

[51] Int. Cl.[2] ..... B65D 71/00

[52] U.S. Cl. ..... 224/45 S; 223/119; 211/37

[58] Field of Search ..... 224/45 S, 45 R; 280/11.38; 211/37; 12/120.5; 223/113, 116, 118, 119

[56] References Cited

U.S. PATENT DOCUMENTS

| | | | |
|---|---|---|---|
| 3,210,787 | 10/1965 | Allsop | 12/120.5 |
| 3,425,564 | 2/1969 | Allsop | 211/37 |
| 3,478,890 | 11/1969 | Allsop | 211/37 |
| 3,729,760 | 5/1973 | Allsop | 12/120.5 |
| 3,870,153 | 3/1975 | Allsop et al. | 211/37 |
| 3,909,718 | 9/1975 | Allsop et al. | 224/45 S |
| 3,958,695 | 5/1976 | Allsop et al. | 211/37 |

*Primary Examiner*—Trygve M. Blix
*Assistant Examiner*—Kenneth Noland

[57] ABSTRACT

A portable base member having oppositely positioned shoe carrying platforms with heel and toe retaining members on each platform. A shoe horn-type device is removably mounted on each heel retaining member in a manner so that it can be removed therefrom and used as a conventional shoe horn. In its installed position a handle portion of each shoe horn device extends outwardly over the heel of a shoe being retained, so that the shoe horn-type device serves an auxiliary retaining function.

23 Claims, 8 Drawing Figures

SHOE RETAINING AND CARRYING DEVICE

BACKGROUND OF THE INVENTION

A. Field of the Invention

The present invention relates to portable shoe retaining and carrying devices, and more particularly to a combination device which incorporates as one of its elements a shoe horn-type device.

B. Brief Description of the Prior Art

There are in the prior art a number of devices, called "shoe trees", by which a pair of shoes can not only be stored in a convenient upright position, but also can be quite easily carried while still mounted to the shoe tree. One such device is shown in U.S. Pat. No. 3,210,787, Allsop, where there is shown an upright base member mounted to a pedestal, the base member presenting a pair of vertical oppositely positioned platforms to which a pair of shoes are mounted. At each platform, there is a heel retaining member and a toe retaining member, with the toe retaining member being slide-mounted to its platform. A handle is provided at the upper end of the vertical base member so that the shoe tree can be used not only as a portable shoe carrier, but also as a shoe storage device.

A number of other patents show various refinements or modifications of this concept. Some of these other devices can serve as portable shoe carriers, and some are arranged to be mounted to a shoe display structure where a plurality of pairs of shoes can be displayed for merchandising. Typical of the other devices in the prior art are those shown in the following U.S. Pat. Nos. 3,425,564, Allsop; 3,478,890, Allsop; 3,729,760, Allsop; 3,870,153, Allsop et al; 3,909,718, Allsop et al; 3,958,698, Allsop et al.

SUMMARY OF THE INVENTION

The present invention combines the basic features of a portable shoe retaining and carrying apparatus with a shoe manipulating device in the configuration of a conventional "shoe horn". This is accomplished in such a way that the shoe manipulating device not only serves its usual function of better enabling a person to place shoes on the person's feet, but also serves an auxiliary shoe retaining function. This is done in a manner that the shoe manipulating device is securely mounted to the apparatus to serve this auxiliary shoe retaining function, but also can be quite conveniently removed from the device to enable the user to put the shoes on more conveniently.

In the apparatus of the present invention, there is a base structure providing at least one support platform adapted to support at least one shoe thereon. There is a first shoe retaining member mounted by an inner end thereof at one end of the platform, and having an outer end to extend outwardly from said platform to engage one end of a shoe placed on the platform. A second shoe retaining member is also mounted to the platform at a location spaced from the first retaining member and also arranged to extend outwardly from the platform to engage a second end of the shoe.

A shoe horn-type shoe manipulating device is provided, this device comprising an elongate foot engaging portion and a handle portion extending laterally from one end of the foot engaging portion. Mounting means are provided to removably attach the shoe manipulating device to the first retaining member, in a manner that the shoe manipulating device can be removed from the apparatus to be used in putting on a shoe retained on the apparatus. In the mounted position, the handle portion of the shoe manipulating device extends laterally in a shoe retaining position over said platform so that with the shoe being carried on the apparatus, the shoe manipulating member can aid in retaining the shoe more securely on the apparatus by virtue of the positioning of the handle portion of the shoe manipulating device.

In the preferred form, the shoe manipulating device is provided with a center mounting opening to receive a securing member which is mounted on the first shoe retaining member. The first shoe retaining member is additionally provided with at least one, and desirably a pair, of second securing members which engage the shoe manipulating device and presses it into proper engagement with the first shoe retaining member. In the preferred form, the first securing member is a securing stud with an oval-shaped lip, and the second securing members comprise a pair of brackets, each having a concave retaining surface. The hole in the shoe manipulating device is oblong so that it can be inserted over the first securing member, after which the shoe manipulating device can be rotated to cause engagement by the second securing members, and cause the oblong lip to engage the shoe manipulating device securely.

In the preferred form, the base provides a pair of oppositely positioned platforms, each having a pair of shoe retaining members to retain a pair of shoes, with each first retaining member having a shoe horn-type shoe manipulating device mounted thereon.

Other features will become apparent from the following description.

DESCRIPTION OF THE PREFERRED EMBODIMENT

Figure 1:
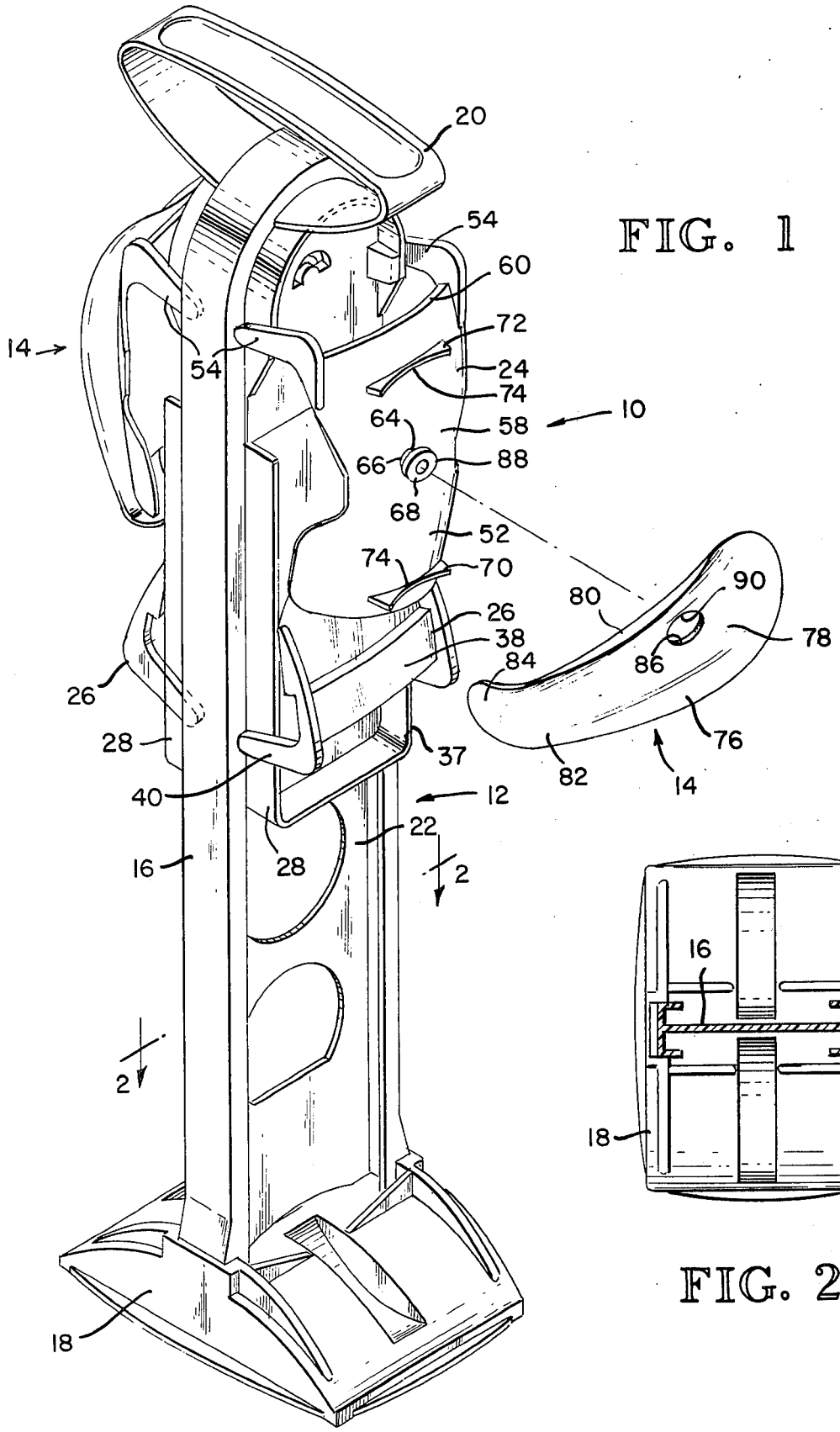
FIG. 1 is an isometric view of the apparatus of the present invention.
Figure 2:
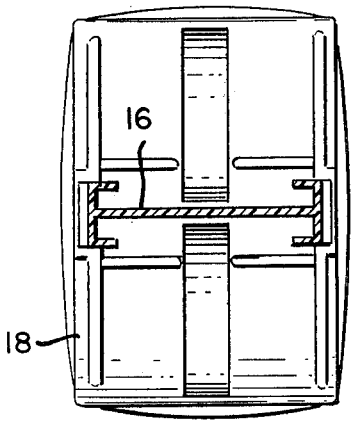
FIG. 2 is a bottom view thereof.

The shoe tree of the present invention is particularly adapted to carry a pair of golf shoes or the like, and accordingly it will be described with reference to that particular application. Since a pair of golf shoes will necessarily be stored for a good deal of their useful life, the shoe tree should, of course, be able to store these conveniently and compactly as possible. However, with the shoe tree serving the additional function of a portable shoe carrier, it has to be recognized that the shoe tree, with the shoes attached thereto, is subjected to a fair amount of jostling, for example, in being carried in the trunk of a car or being brought to some location where the shoes are placed on the golfer's feet. Thus, it is particularly critical that the shoes be retained securely on the shoe tree so that it can reliably perform its portable shoe carrying function.

The apparatus of the present invention is generally designated 10, and comprises two main components, namely: a). a portable shoe retaining and carrying device 12, and b). a combination shoe manipulating device and auxiliary retaining device 14. For convenience of description, since the shoe retaining and carrying device has the general configuration and operation of a conventional shoe tree, in the following description it will simply be referred to as the "shoe tree 12". Since the combination shoe manipulating device and auxiliary securing device has the general configuration and characteristics of a conventional shoe horn, in the following description it will simply be called the "shoe horn 14". However, it should be recognized that the combination of the present invention is not simply an obvious joinder of two common prior art devices, since both the shoe tree 12 and the shoe horn 14 must be especially modified and adapted in a particular manner to properly perform their intended functions. Further, the shoe horn 14, in addition to performing its conventional function of aiding in the putting on of shoes, also has an auxiliary shoe retaining function.

With regard to the shoe tree 12, there is an elongate base 16 having a lower end connected to a pedestal 18 and an upper end connected to a carrying handle 20. The base 16 has length and width dimensions corresponding generally to a pair of shoes to be carried thereon, and can be considered as presenting two shoe supporting platforms 22 positioned on opposite sides of the base 16.

At the upper end of each base is a first retaining member 24 adapted to engage a heel portion of a shoe being carried on its related platform 22. A pair of second retaining members 26, each adapted to engage a toe portion of a shoe, are provided at a location beneath the first retaining members 24. Each second toe retaining member 26 is mounted to a slide member 28 mounted for slide motion along the length of the platform 22. A pair of rubber bands 30 are provided in the interior portion of the base 16, each rubber band 30 being mounted at the upper end to a stationary finger 32 connected to the base 16, and at the lower end to a second finger 34 mounted on the inner side of a related slide member 28. Each rubber band urges its related slide member 26 upwardly toward the heel retaining member 24. Thus, when a shoe is placed between a pair of retaining members 24 and 26, the urging of the rubber band 30 against the toe retaining member 26 causes the two retaining members 24 and 26 to hold a shoe (shown in FIG. 3 at 36) against its related platform 22.

The slide member 28 is formed with a peripheral upstanding flange 37. Thus, when the sole of a golf shoe is placed against the slide member 28, the spikes **36*a* of the shoe 36 fit into the depression defined by the surrounding flange 37**.

Figure 7:
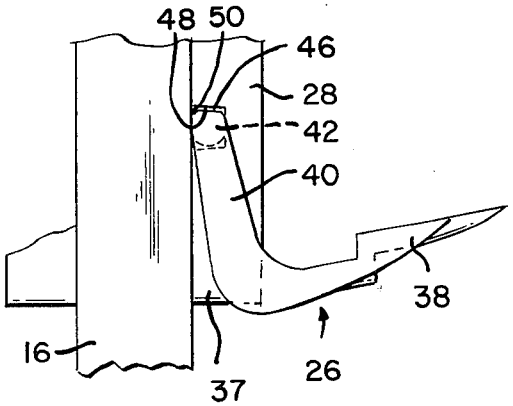
FIG. 7 is a side view of one of the toe retaining members in its outwardly extending engaging position.
Figure 8:
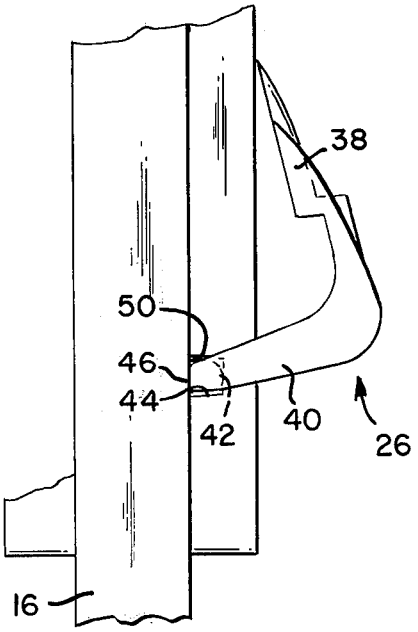
FIG. 8 is a view similar to FIG. 7, showing the toe retaining member of FIG. 7 in a stowed position.

With regard to the particular arrangement of the toe retaining member 26, reference is made to FIGS. 7 and 8, where the toe retaining member 26 can be seen to comprise an upper retaining portion 38 having a configuration to engage a toe of a shoe, and a pair of mounting arms 40 positioned on opposite sides of the base 16. Each mounting arm is pivotally mounted to the base 16 by means of a laterally inwardly extending finger 42 fitting in an opening 44 in the slide member 28. The finger 42 has a generally round configuration, with one flattened surface 46 adapted to engage either of two flattened retaining surfaces 48 and 50 in the base 16. When the flattened surface 46 is engaging the surface 48 (see FIG. 7), the toe retaining member 26 is held in its outwardly extending retaining position by reason of the two flattened surfaces 46 and 48 engaging one another to resist rotational movement of the retaining member 26.

When the toe retaining member 26 is rotated 90° downwardly toward its stowed position, as shown in FIG. 8, the flattened surface 46 of the finger 42 is moved out of engagement with the surface 48 and comes into engagement with the second surface 50, with the engagement of the two surfaces 46 and 50 holding the toe retaining member 26 in its downwardly stowed position, as in FIG. 8. The material forming the base 16 and the retaining finger 42 of the toe retaining member 26 are both sufficiently yielding to permit moderate compression of the material at the surface areas 46–50 to allow the toe retaining member 26 to be moved "over center" between its two positions shown in FIGS. 7 and 8.

Figure 3:
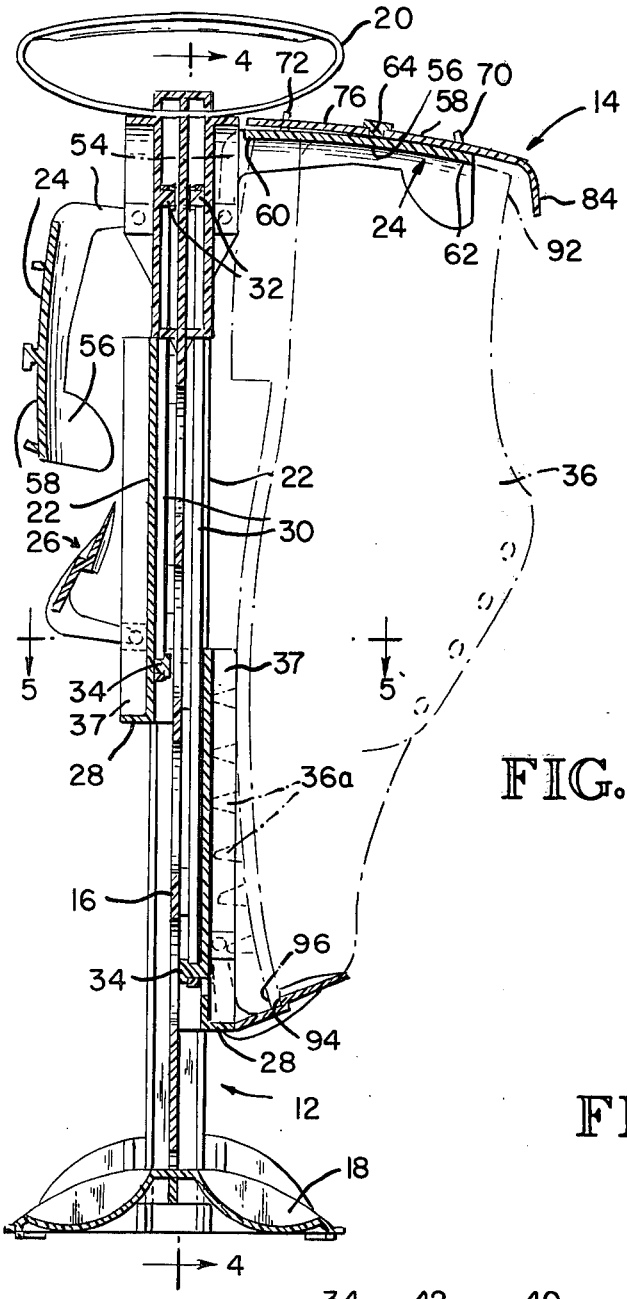
FIG. 3 is a side elevational view of the apparatus, showing one set of shoe retaining members in their retaining positions, and a second set of shoe retaining members in a stowed position.
Figure 4:
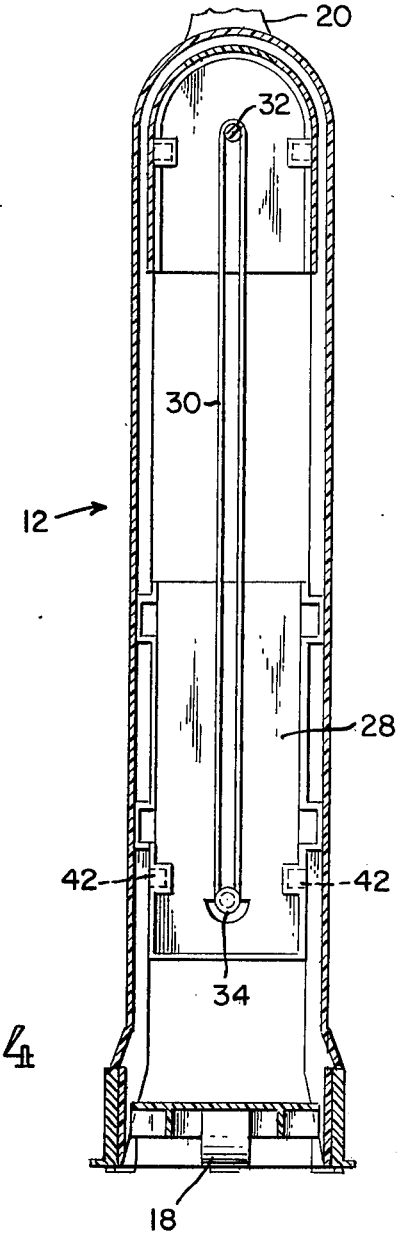
FIG. 4 is a longitudinal sectional view taken along line 4—4 of FIG. 3.
Figure 5:
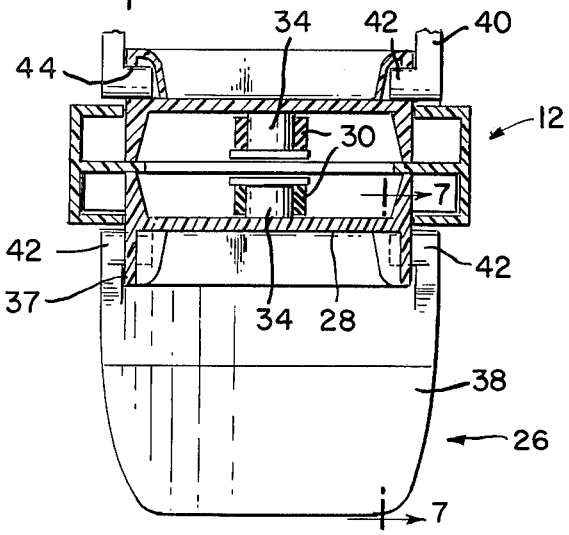
FIG. 5 is a transverse sectional view taken along line 5—5 of FIG. 3.

While not shown in detail herein, the heel retaining member 24 is similarly mounted to the base 16 so that it will be held in either an upright retaining position or a down stowed position. The upright retaining position and the stowed position of both the heel retaining members 24 and the toe retaining members 26 are shown in FIG. 3.

The particular configuration of each heel retaining member 24 is particularly significant in the present invention, and thus will be described in detail herein. Each heel retaining member 24 comprises a retaining portion 52, contoured to engage a heel of a shoe, and a pair of mounting arms 54 by which it is pivotally mounted to the base 16 in a manner similar to the toe retaining member 26.

To describe the heel retaining member 24 more specifically, it has a concave heel engaging surface 56 and an oppositely positioned convex surface 58 at which its related shoe horn 14 is mounted. The retaining portion 52 of the heel retaining member 24 has an inner end 60 positioned adjacent the base 16, and an outer end 62. Intermediate its two ends 60 and 62 and extending a short distance outwardly from the convex surface 58 is a retaining stud 64 having a circular portion 66 of a first smaller diameter, this circular portion 66 connecting directly to the retaining member 24, and an outer oval shaped securing lip 68. A pair of upper and lower securing brackets 70 and 72 respectively, are mounted to the convex side 58 of the retaining portion 52 of the member 24, one adjacent the inner end 60 and one adjacent the outer end 62. Each securing bracket has a concave contact face 74 of a curvature generally matching that of the shoe horn 14.

The shoe horn 14 has the overall configuration of a conventional shoe horn, and thus comprises a main body 76 having elongate configuration, moderately curved in transverse section, with a concave surface 78 and an opposite convex surface 80. At one end 82 of the body 76 there is a handle 84 extending generally at right angles to the lengthwise axis of the body 76 of the shoe horn 14.

The body 76 of the shoe horn 14 is formed with an oval opening 86, this opening 86 being positioned approximately intermediate the two ends of the shoe horn 14. This oval opening 86 has generally the same configuration as the oval configuration of the securing lip 68 of the retaining stud 64, with the dimensions of the opening 86 being slightly larger than the securing lip 68.

Figure 6:
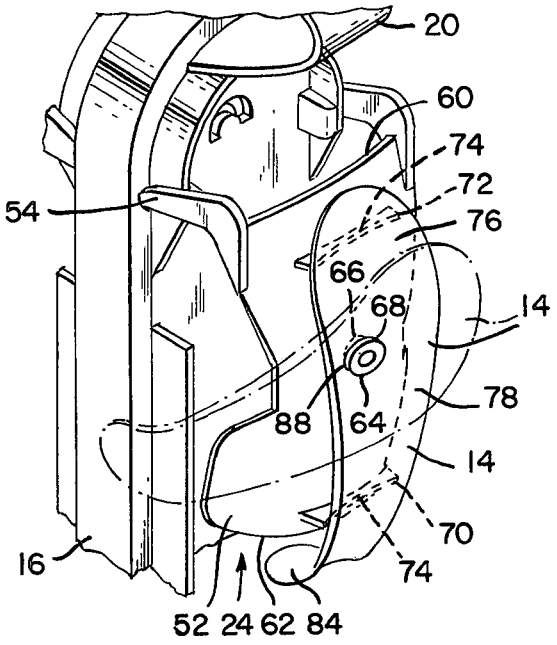
FIG. 6 is a perspective view of a heel retaining portion of the apparatus, in which the manner of securing the shoe manipulating member to the apparatus is shown, with the shoe manipulating device being shown in broken lines in an intermediate position and in full lines in its fully secure position.

To attach the shoe horn 14 to the heel retaining member 24, reference is made to FIG. 1 where the shoe horn 14 is spaced moderately away from the heel retaining member 24, with the lengthwise axis of the shoe horn 14 being crossways with respect to the lengthwise axis of the retaining member 24. In this position, the lengthwise dimension of the opening 86 is aligned with the lengthwise dimension of the securing lip 68 of the stud 64. Thus, the shoe horn 14 can be moved toward the member 24, with the securing lip 68 passing through the opening 86, so that the shoe horn 14 moves into the position shown in broken lines in FIG. 6. The shoe horn 14 is then pivoted 90° about the securing stud 64 so that the outer edge portions 88 of the securing lip 68 fit over lateral edge portion 90 adjacent the opening 86 in the shoe horn 14. As the shoe horn 14 is rotated from the dotted line position of FIG. 6 to the full line position, the two opposite ends of the body 76 of the shoe horn 17 come into engagement with the two concave contact surfaces 74 of the securing brackets 70 and 72. The shoe horn 14 is made of a material which is sufficiently resilient to permit the shoe horn 14 to "ride over" the edge portions of the securing brackets 70 and 72 and spring into firm securing engagement with the contact surfaces 74 of the brackets 70 and 72. In this position, the securing lip 68 holds the shoe horn 14 securely against the brackets 70 and 72.

In this installed position, it can be seen that the handle 84 extends over and beyond the outer end 62 of the retaining portion 52 of the heel retaining member 24. Thus, in the shoe retaining position, the shoe horn handle 84 extends over an upper heel portion 92 of the shoe 36 being retained on the shoe tree 12 (see FIG. 3). If there is any jostling or unusual jar to the shoe tree 12, so that the heel portion of the shoe 36 would tend to slide outwardly from the heel retaining member 24, the handle portion 84 of the shoe horn 14 serves an auxiliary retaining function to prohibit further outward movement of the heel portion 92 of the shoe 36.

For convenience of illustration, in FIG. 3 the handle portion 84 of the shoe horn 14 is shown spaced a slight distance away from the heel portion 92 of the shoe 36. However, it is to be understood that the handle portion 84 can be positioned closely adjacent the heel 92 so that acting in combination with the toe retaining member 26, both ends of the shoe 36 are pressed downwardly toward its platform 22. The toe retaining member 26 is provided with a contact shoulder 94 to engage a front sole portion 96 of the shoe 36. Thus, the toe retaining member 26 cooperates with the handle portion 84 to hold the shoe 36 in a straightened position and thus prevent curling of the shoe during non-use.

The shoes 36 can easily be removed from the shoe tree 12 simply by pushing the toe of the shoe 36 against the toe retaining member 26 until the heel portion 92 of the shoe 36 is free of the shoe horn handle 84. Then the shoe horn 14 can be removed from the heel retaining member 24 by following in reverse the steps described with reference to FIGS. 1 and 6, by which the shoe horn 14 is attached to the heel securing member 24. After the shoe horn 14 is used to assist the person in placing the shoes 36 on the person's feet, the shoe horn 14 can be reinstalled to its securing position on the member 24.

As a modification of the mounting of the shoe horn 14, it is possible to utilize only one of the brackets 70 and 72 to position the shoe horn securely on the heel retaining member 24. If, for example, the outer bracket 70 were eliminated, then the bracket 72 would be so positioned that the outwardly positioned end of the shoe horn would be pressed into engagement directly against the convex surface of the heel retaining member 24.

What is claimed is:

1. A combination shoe retaining and carrying apparatus, said apparatus comprising:

a. a base structure providing a support platform adapted to support at least one shoe thereon, b. a first shoe retaining member mounted by an inner end thereof at one end of said platform, and having an outer end to extend outwardly from said platform to engage one end of a shoe on said platform, c. a second shoe retaining member mounted at said platform at a location spaced from said first retaining member and arranged to extend from said platform to engage a second end of said shoe on said platform, d. a shoe horn-type shoe manipulating device comprising an elongate foot engaging portion and a handle portion extending laterally from said foot engaging portion, e. mounting means to removably attach said shoe manipulating device to said first retaining member, said mounting means arranged to position the handle portion of the shoe manipulating device in a laterally extending shoe retaining position over said platform so as to extend over a shoe retained on said platform, whereby said shoe manipulating device can be removed from said apparatus to be used in putting on a shoe retained on said apparatus, and with said shoe being placed on said apparatus to be retained thereby, said shoe manipulating device is able to perform an auxiliary shoe retaining function to hold said shoe more securely to the apparatus.

2. The apparatus as recited in claim 1, wherein said first shoe retaining member is a member contoured and positioned on said base structure to retain a heel portion of a shoe, said first shoe retaining member having a first contact surface to engage said heel portion and an opposite mounting surface at which said shoe manipulating device is mounted, said mounting means comprising a first stud and hole type mounting device positioned at one location on said first shoe securing member, and at least one bracket type securing device spaced laterally from said stud and hole securing device.

3. The apparatus as recited in claim 2, wherein said stud and hole mounting device comprises a securing stud mounted to the second surface of said first shoe retaining member, said securing stud comprising an elongate securing lip having a lengthwise dimension greater than its width dimension, said shoe manipulating device having an opening therein corresponding in configuration to said securing lip, said securing lip and said opening being so arranged that when said securing lip and said opening are in alignment, a longitudinal axis of said shoe manipulating device is positioned transversely to a longitudinal axis of said first shoe retaining member, whereby said shoe manipulating device can be aligned transversely to said first shoe retaining member for engagement of said securing stud in said opening, and then rotated to a securing position against said first shoe retaining member.

4. The apparatus as recited in claim 3, wherein there are a pair of securing brackets mounted on opposite sides of said securing stud, each of said securing brackets providing a concave contact surface to engage a matching surface of said shoe manipulating device.

5. The apparatus as recited in claim 1, wherein each of said first and second shoe retaining members has a pair of laterally spaced mounting arms by which each is pivotally connected to said base structure, each of said pivot connections having an over-center mounting whereby each retaining member has a first over-center outwardly extending retaining position, and a second over-center stowed position in which each retaining member is rotated approximately 90° from its retaining position so as to be against said base structure in its stowed position.

6. The apparatus as recited in claim 5, wherein there is for each of said retaining members a pair of inter-engaging flat over-center surfaces, one of which is in securing engagement with its related shoe retaining member in its retaining position, and the other of which surfaces is in securing engagement with its related shoe retaining member in its stowed position.

7. The apparatus as recited in claim 1, wherein said first shoe retaining member is a member contoured and positioned on said base structure to retain a heel portion of a shoe, said first shoe retaining member having a first contact surface to engage said heel portion and an opposite mounting surface at which said shoe manipulating device is mounted, said mounting means comprising a first stud and hole type mounting device positioned at one location on said first shoe securing member, and at least one bracket type securing device spaced laterally from said stud and hole securing device, said toe retaining member being mounted to a slide member slide mounted to said base, said slide member having outwardly extending peripheral flange means defining a recessed area to receive spikes of a related golf shoe to be retained in said apparatus, said peripheral flange means inhibiting lateral motion of said golf shoe relative to said apparatus.

8. The apparatus as recited in claim 1, wherein:

a. said first retaining member is a member contoured and positioned on said base structure to retain a heel portion of a shoe, said first shoe retaining member having a first contact surface to engage said heel portion and an opposite mounting surface at which said shoe manipualting device is mounted, said mounting means comprising a first stud and hole type mounting device positioned at one location on said first shoe securing member, and at least one bracket-type securing device spaced laterally from said stud and hole securing device, b. said stud and hole mounting device comprises a securing stud mounted to the second surface of said first shoe retaining member, said securing stud comprising an elongate securing lip having a lengthwise dimension greater than its width dimension, said shoe manipulating device having an opening therein corresponding in configuration to said securing lip, said securing lip and said opening being so arranged that when said securing lip and said opening are in alignment, a longitudinal axis of said shoe manipulating device is positioned transversely to a longitudinal axis of said first shoe retaining member, whereby said shoe manipulating device can be aligned transversely to said first shoe retaining member for engagement said securing stud in said opening, and then rotated to a securing position against said first shoe retaining member, c. each of said first and second shoe retaining members has a pair of laterally spaced mounting arms by which each is pivotally connected to said base structure, each of said pivot connections having an over-center mounting whereby each retaining member has a first over-center outwardly extending retaining position, and a second over-center stowed position in which each retaining member is rotated approximately 90° from its retaining position so as to be against said base structure in its stowed position, d. there is for each of said retaining members a pair of inter-engaging flat over-center surfaces, one of which is in securing engagement with its related shoe retaining member in its retaining position, and the other of which surfaces is in securing engagement with its related shoe retaining member in its stowed position, and e. said toe retaining member is mounted to a slide member, slide mounted to said base, said slide member having outwardly extending peripheral flange means defining a recessed area to receive spikes of a related golf shoe to be retained in said apparatus, said peripheral flange means inhibiting lateral motion of said golf shoe relative to said apparatus.

9. The apparatus as recited in claim 1, wherein said first shoe retaining member is a member contoured and positioned on said base structure to retain a heel portion of a shoe, each of said first shoe retaining members having a first contact surface to engage said heel portion and an opposite mounting surface at which its shoe manipulating device is mounted, said mounting means comprising a first stud and hole-type mounting device positioned at one location on its first shoe securing member, and at least one bracket-type securing device spaced laterally from its related stud and hole securing device, each of said toe retaining members being mounted to a related slide member slide mounted to said base, said slide member having outwardly extending peripheral flange means defining a recessed area to receive spikes of a related golf shoe to be retained in said apparatus, each of said peripheral flange means inhibiting lateral motion of its related golf shoe relative to said apparatus.

10. A shoe retaining and carrying apparatus, said apparatus comprising:

a. base structure providing a pair of oppositely positioned support platforms, each adapted to support at least one shoe thereon, b. a pair of first shoe retaining members, each mounted by an inner end thereof at one end of a related one of said platforms, and each having an outer end to extend outwardly from its related platform to engage one end of a related shoe on its said platform, c. a pair of second shoe retaining members mounted at its related platform at a location spaced from its related first retaining member and arranged to extend from its related platform to engage a second end of the shoe on its platform.

d. a pair of shoe horn-type shoe manipulating devices, each comprising an elongate foot engaging portion and a handle portion extending laterally from the said foot engaging portion, and e. a pair of mounting means to removably attach each related shoe manipulating device to its related first retaining member, each of said mounting means arranged to position the handling portion of its shoe manipulating device in a laterally extending shoe retaining position over its platform so as to extend over a shoe retained on its platform, whereas one of said shoe manipulating devices can be removed from said apparatus to be used in putting on a shoe retained on said apparatus, and with said shoe being placed on said apparatus to be retained thereby, said shoe manipulating device is able to perform an auxiliary shoe retaining function to hold said shoe more securely to the apparatus.

11. The apparatus as recited in claim 10, wherein each of said first shoe retaining members is a member contoured and positioned on said base structure to retain a heel portion of a shoe, each of said first shoe retaining members having a first contact surface to engage said heel portion and an opposite mounting surface at which its shoe manipulating device is mounted, said mounting means comprising a first stud and hole-type mounting device positioned at one location on its first shoe securing member, and at least one bracket-type securing device spaced laterally from its related stud and hole securing device.

12. The apparatus as recited in claim 11, wherein each of said stud and hole mounting devices comprises a securing stud mounted to the second surface its related first shoe retaining member, each of said securing studs comprising an elongate securing lip having a lengthwise dimension greater than its width dimension, each of said shoe manipulating devices having an opening therein corresponding in configuration to said securing lip, said securing lip and said opening being so arranged that when said securing lip and said opening are in alignment, a longitudinal axis of said shoe manipulating device is positioned transversely to a longitudinal axis of said first shoe retaining member, whereby said shoe manipulating device can be aligned transversely to said first shoe retaining member for engagement of said securing stud in said opening, and then rotated to a securing position against said first shoe retaining member.

13. The apparatus as recited in claim 12, wherein there are a pair of securing brackets mounted on opposite sides of each securing stud, each of said securing brackets providing a concave contact surface to engage a matching surface of a related shoe manipulating device.

14. The apparatus as recited in claim 10, wherein each of said first and second shoe retaining members has a pair of laterally spaced mounting arms by which each is pivotally connected to said base structure, each of said pivot connections having an over-center mounting whereby each retaining member has a first over-center outwardly extending retaining position and a second over-center stowed position in which each retaining member is rotated approximately 90° from its retaining position so as to be against said base structure in its stowed position.

15. The apparatus as recited in claim 14, wherein there is for each of said retaining members a pair of inter-engaging flat over-center surfaces, one of which is in securing engagement with its related shoe retaining member in its retaining position, and the other of which surfaces is in securing engagement with its related shoe retaining member in its stowed position.

16. The apparatus as recited in claim 10, wherein:

a. each of said first shoe retaining members is a member contoured and positioned on said base structure to retain a heel portion of a shoe, each of said first shoe retaining members having a first contact surface to engage said heel portion and an opposite mounting surface at which its shoe manipulating device is mounted, said mounting means comprising a first stud and holetype mounting device positioned at one location on its first shoe securing member, and at least one bracket-type securing device spaced laterally from its related stud and hole securing device, b. each of said stud and hole mounting devices comprises a securing stud mounted to the second surface of its related first shoe retaining member, each of said securing studs comprising an elongate securing lip having a lengthwise dimension greater than its width dimension, each of said shoe manipulating devices having an opening therein corresponding in configuration to said securing lip, said securing lip and said opening being so arranged that when said securing lip and said opening are in alignment, a longitudinal axis of said shoe manipulating device is positioned transversely to a longitudinal axis of said first shoe retaining member, whereby said shoe manipulating device can be aligned transversely to said first shoe retaining member for engagement of said securing stud in said opening, and then rotated to a securing position against said first shoe retaining member, c. each of said first and second shoe retaining members has a pair of laterally spaced mounting arms by which each is pivotally connected to said base structure, each of said pivot connections having an over-center mounting whereby each retaining member has a first over-center outwardly extending retaining position and a second over-center stowed position in which each retaining member is rotated approximately 90° from its retaining position so as to be against said base structure in its stowed position, d. there is for each of said retaining members a pair of inter-engaging flat over-center surfaces, one of which is in securing engagement with its related shoe retaining member in its retaining position, and the other of which surfaces is in securing engagement with its related shoe retaining member in its stowed position, and e. each of said toe retaining members being mounted to a related slide member slide mounted to said base, each slide member having outwardly extending peripheral flange means defining a recessed area to receive spikes of a related golf shoe to be retained in said apparatus, each of said peripheral flange means inhibiting lateral motion of its related gold shoe relative to said apparatus.

17. A combination shoe retaining and carrying apparatus, said apparatus particularly adapted to be used in combination with a shoe horn type shoe manipulating device having a foot engaging portion and a handle portion extending laterally from said foot engaging portion, comprising:

a. a base structure providing a support platform adapted to support at least one shoe thereon, b. a first shoe retaining member mounted by an inner end thereof at one end of said platform, and having an outer end to extend outwardly from said platform to engage one end of a shoe on said platform, c. a second shoe retaining member mounted at said platform at a location spaced from said first retaining member and arranged to extend from said platform to engage a second end of said shoe on said platform, and d. mounting means adapted to removably attach said shoe manipulating device to said first retaining member, said mounting means arranged to position the handle portion of the shoe manipulating device in a laterally extending shoe retaining position over said platform so as to extend over a shoe retained on said platform, whereby said shoe manipulating device can be removed from said apparatus to be used in putting on a shoe retained on said apparatus, and with said shoe being placed on said apparatus to be retained thereby, said shoe manipulating device is able to perform an auxiliary shoe retaining function to hold said shoe more securely to the apparatus.

18. The apparatus as recited in claim 17, wherein said first shoe retaining member is a member contoured and positioned on said base structure to retain a heel portion of a shoe, said first shoe retaining member having a first contact surface to engage said heel portion and an opposite mounting surface at which said shoe manipulating device is mounted, said mounting means comprising a first stud and hole type mounting device positioned at one location on said first shoe securing member, and at least one bracket type securing device spaced laterally from said stud and hold securing device.

19. The apparatus as recited in claim 18, wherein said stud and hole mounting device comprises a securing stud mounted to the second surface of said first shoe retaining member, said securing stud comprising an elongate securing lip having a lengthwise dimension greater than its width dimension, adapted to engage an opening in the shoe manipulating device corresponding in configuration to said securing lip, said securing lip being so arranged that when said securing lip and said opening are in alignment, a longitudinal axis of said shoe manipulating device is positioned transversely to a longitudinal axis of said first shoe retaining member, whereby said shoe manipulating device can be aligned transversely to said first shoe retaining member for engagement of said securing stud in said opening, and then rotated to a securing position against said first shoe retaining member.

20. The apparatus as recited in claim 17, wherein each of said first and second shoe retaining members has a pair of laterally spaced mounting arms by which each is pivotally connected to said base structure, each of said pivot connections having an over-center mounting whereby each retaining member has a first over-center outwardly extending retaining position, and a second over-center stowed position in which each retaining member is rotated approximately 90° from its retaining position so as to be against said base structure in its stowed position.

21. The apparatus as recited in claim 20, wherein there is for each of said retaining members a pair of inter-engaging flat over-center surfaces, one of which is in securing engagement with its related shoe retaining member in its retaining position, and the other of which surfaces is in securing engagement with it related shoe retaining member in its stowed position.

22. The apparatus as recited in claim 17, wherein said first shoe retaining member is a member contoured and positioned on said base structure to retain a heel portion of a shoe, said first shoe retaining member having a first contact surface to engage said heel portion and an opposite mounting surface at which said shoe manipulating device is mounted, said mounting means comprising a first stud and hole type mounting device positioned at one location on said first shoe securing member, and at least one bracket type securing device spaced laterally from said stud and hold securing device, said toe retaining member being mounted to a slide member slide mounted to said base, said slide member having outwardly extending peripheral flange means defining a recessed area to receive spikes of a related golf shoe to be retained in said apparatus, said peripheral flange means inhibiting lateral motion of said golf shoe relative to said apparatus.

23. The apparatus as recited in claim 17, wherein:

a. said first retaining member is a member contoured and positioned on said base structure to retain a heel portion of a shoe, said first shoe retaining member having a first contact surface to engage said heel portion and an opposite mounting surface at which said shoe manipulating device is mounted, said mounting means comprising a first stud and hole type mounting device positioned at one location on said first shoe securing member, and at least one bracket-type securing device spaced laterally from said stud and hole securing device, b. said stud and hole mounting device comprises a securing stud mounted to the second surface of said first shoe retaining member, said securing stud comprising an elongate securing lip having a lengthwise dimension greater than its wide dimension, adapted to engage an opening in the shoe manipulating device corresponding in configuration to said securing lip, said securing lip being so arranged that when said securing lip and said opening are in alignment, a longitudinal axis of said shoe manipulating device is positioned transversely to a longitudinal axis of said first shoe retaining member, whereby said shoe manipulating device can be aligned transversely to said first shoe retaining member for engagement said securing stud in said opening, and then rotated to a securing position against said first shoe retaining member, c. each of said first and second shoe retaining members has a pair of laterally spaced mounting arms by which each is pivotally connected to said base structure, each of said pivot connections having an over-center mounting whereby each retaining member has a first over-center outwardly extending retaining position, and a second over-center stowed position in which each retaining member is rotated approximately 90° from its retaining position so as to be against said base structure in its stowed position, d. there is for each of said retaining members a pair of inter-engaging first over-center surfaces, one of which is in securing engagement with its related shoe retaining member in its retaining position, and the other of which surfaces is in securing engagement with its related shoe retaining member in its stowed position, and e. said toe retaining member is mounted to a slide member, slide mounted to said base, said slide member having outwardly extending peripheral flange means defining a recessed area to receive spikes of a related golf shoe to be retained in said apparatus, said peripheral flange means inhibiting lateral motion of said golf shoe relative to said apparatus.

* * * * *

UNITED STATES PATENT AND TRADEMARK OFFICE

CERTIFICATE OF CORRECTION

PATENT NO. : 4,113,159

DATED : September 12, 1978

INVENTOR(S) : Ivor J. Allsop

It is certified that error appears in the above-identified patent and that said Letters Patent are hereby corrected as shown below:

In column 8, line 32 (i.e., the first line of claim 9) change the numeral 1 to --10--.

Signed and Sealed this

*Twenty-seventh* Day of *May 1980*

[SEAL]

*Attest:*

SIDNEY A. DIAMOND

*Attesting Officer*

*Commissioner of Patents and Trademarks*